US005967542A

United States Patent [19]

Williams et al.

[11] Patent Number: 5,967,542

[45] Date of Patent: Oct. 19, 1999

[54] MOUNTING DISK AND BASE FOR SNOWBOARD BINDING

[75] Inventors: Mark L. Williams; John D. Moore, both of Seattle; Wenhao Wu, Redmond, all of Wash.; Hubert R. Zemke, Carson City, Nev.; Lars L. Pak, Seattle, Wash.

[73] Assignee: Sims Sports, Inc., Mill Creek, Wash.

[21] Appl. No.: 08/977,817

[22] Filed: Nov. 25, 1997

[51] Int. Cl.[6] ..... A63C 9/00

[52] U.S. Cl. ..... 280/618; 280/14.2; 280/617

[58] Field of Search ..... 280/607, 14.2, 280/617, 618, 630

[56] References Cited

U.S. PATENT DOCUMENTS

| | | | |
|---|---|---|---|
| 2,740,972 | 4/1956 | Taylor . | |
| 2,919,452 | 1/1960 | Kluge . | |
| 3,172,678 | 3/1965 | Beyl . | |
| 4,040,137 | 8/1977 | Fetherston et al. . | |
| 4,718,873 | 1/1988 | Shaw et al. . | |
| 4,871,337 | 10/1989 | Harris . | |
| 5,021,017 | 6/1991 | Ott . | |
| 5,046,746 | 9/1991 | Gierveld . | |
| 5,236,216 | 8/1993 | Ratzek | 280/607 |
| 5,261,689 | 11/1993 | Carpenter et al. . | |
| 5,356,170 | 10/1994 | Carpenter et al. | 280/618 |
| 5,544,909 | 8/1996 | Laughlin et al. . | |
| 5,580,077 | 12/1996 | Dodge . | |
| 5,713,587 | 2/1998 | Morrow et al. | 280/14.2 |
| 5,782,476 | 7/1998 | Fardie | 280/14.2 |
| 5,791,678 | 8/1998 | Perlman | 280/618 |

FOREIGN PATENT DOCUMENTS

| | | |
|---|---|---|
| 0 788 819 A2 | 8/1997 | European Pat. Off. . |
| 196 19676 A1 | 7/1997 | Germany . |

*Primary Examiner*—Lanna Mai
*Assistant Examiner*—David R. Dunn
*Attorney, Agent, or Firm*—Townsend and Townsend and Crew LLP

[57] ABSTRACT

A snowboard binding mounting disk (24) includes a body (28) through which 3-hole and 4-hole patterns (8, 10) of mounting holes are formed. The centers of a pair of the 3-hole mounting holes are separated by a base distance (Z). The centers of a pair of the 4-hole mounting holes are separated by an end distance (Y). The end and base distances differ by a distance delta. The pair of end holes and the pair of base holes are positioned adjacent to one another so that the end and base holes overlap one another to create a pair of oblong, dual purpose holes (30). A removable and replaceable mounting element positioner (29) is mounted to the oblong holes at one of two stable positions. The position chosen is determined by whether the dual purpose holes are to be used for the 3-hole pattern or for the 4-hole pattern. The central opening (20) in the base is preferably made by stamping a grooved peripheral surface (22) sized to engage a complementary grooved surface (53) on the disk.

3 Claims, 5 Drawing Sheets

MOUNTING DISK AND BASE FOR SNOWBOARD BINDING

BACKGROUND OF THE INVENTION

One style of conventional snowboard bindings includes a base from which an upwardly extending heel support extends. An instep strap and a toe strap are typically used to secure the boot to the binding. The base of the binding is typically mounted to the snowboard through the use of a mounting disk. A mounting disk typically has a grooved or serrated outer peripheral edge which mates with a similar grooved or serrated surface surrounding a central opening formed in the base of the binding. The mounting disk is then secured to the snowboard, typically using screws, causing the binding base to be secured to the snowboard as well. The grooved peripheral surfaces permit the snowboard binding to be oriented over a range of rotary orientations relative to the centerline of the snowboard to accommodate the different angular orientations desired by different snowboarders.

The grooved or serrated surface is typically formed in metal binding bases by machining. Plastic bases and metal and plastic mounting disks are typically molded or cast as a finished product, including the necessary grooved or serrated peripheral surfaces, a distinct cost advantage over the machining operation required with conventional metal binding bases.

Currently, there are two common hole patterns formed in snowboards for mounting snowboard bindings. The first, and most common, is a rectangular 4-hole pattern, while the second in use is a triangular 3-hole pattern. To ensure that a snowboard binding can be used with snowboards having either type of hole pattern presently requires that two different mounting disks be supplied with each binding.

SUMMARY OF THE INVENTION

One aspect of the present invention is directed to a snowboard binding mounting disk which eliminates the need for providing two different mounting disks to accommodate two different hole patterns commonly encountered with conventional snowboards. The invention increases the number of sets of hole patterns which are formed in the mounting disk by permitting some of the mounting holes of the different hole patterns to overlap, which creates oblong, dual-purpose mounting holes, and by the use of mounting screw-positioners with each dual-purpose hole. Doing so eliminates extra costs associated with providing two mounting plates with each binding, thus lowering the cost to the consumer. Another aspect of the invention simplifies the formation of the grooved or serrated surface in metal snowboard binding bases by creating the grooves during a stamping operation. This eliminates the cost associated with machining the grooves.

The snowboard binding mounting disk includes a body having upper and lower surfaces through which first and second patterns of first and second mounting holes are formed. The first pattern of mounting holes is typically a 3-hole pattern, while the second pattern is typically a 4-hole pattern. Each of the holes has a center. The centers of a pair of the first mounting holes in one embodiment are separated by a base distance. The centers of a pair of the second mounting holes are separated by an end distance. The end and base distances are not equal but differ by a distance delta. The pair of end holes and the pair of base holes are preferably positioned adjacent to one another so that the end and base holes overlap one another to create a pair of oblong, dual purpose holes. A removable and replaceable mounting element positioner is mounted to the oblong holes at one of two stable positions. The positions are determined by whether the dual purpose holes are to be used for, in this example, the 3-hole pattern or for the 4-hole pattern. The use of a mounting disk made according to the invention permits a snowboard binding to be mounted to a snowboard having either a 4-hole pattern of mounting holes or a 3-hole pattern of mounting holes.

The positioning of the mounting element positioner at one of two stable positions is preferably achieved by forming a recessed region in the peripheral edge of the positioner. The body has first and second extensions at the dual purpose holes sized for receipt of the recessed region when the positioner is in either of the first or second orientations.

The use of a stamped metal base provides the strength and rigidity of metal but without the expense associated with groove-machining operations. The base can be made by first simply stamping a base blank from a flat sheet of metal. The base blank will then have its lateral edges bent upwardly to create the desired shallow U-shaped base with all holes formed therein and the grooved internal peripheral surface formed during the stamping operation.

Other features and advantages of the invention will appear from the following description in which the preferred embodiments have been set forth in detail in conjunction with the accompanying drawings.

DESCRIPTION OF THE PREFERRED EMBODIMENT

Figure 1A:
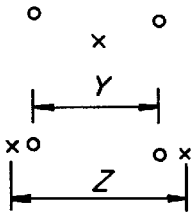
FIG. 1A is a simplified schematic view of the relative positions of the centers for one set of a 3-hole hole pattern and one set of a 4-hole hole pattern.
Figure 1:
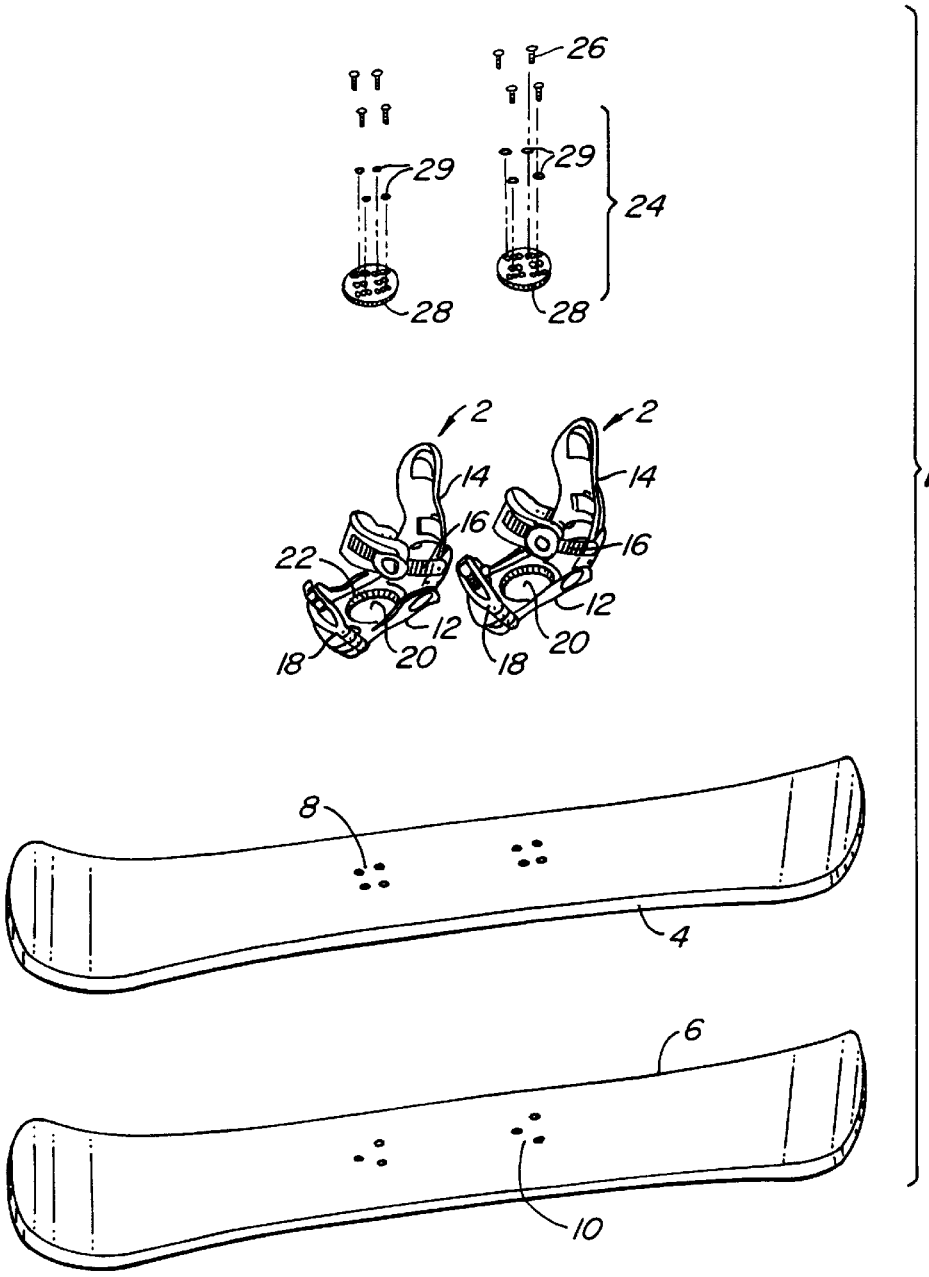
FIG. 1 is an exploded isometric view illustrating a snowboard binding including a mounting disk and base made according to the invention in conjunction with a pair of snowboards having two different mounting hole patterns.

FIG. 1 illustrates a snowboard binding 2 positioned above two snowboards 4,6. Snowboard 4 has a 3-hole mounting hole pattern 8, while snowboard 6 has a 4-hole mounting hole pattern 10, both being conventional mounting hole patterns. Binding 2 includes a binding base 12 from which a heel support 14 extends upwardly. Instep and toe straps 16,18 are also used. A central opening 20 is formed in base 12. Opening 20 is defined by a downwardly and inwardly tapering peripheral surface 22 having a series of grooves or serrations formed in the surface. When base 12 is a metal base, opening 20 is preferably formed by a stamping operation to create a stamped grooved peripheral surface; this aspect is discussed below with respect to FIGS. 7–12.

To secure base 12 to either of snowboards 4,6, a snowboard binding mounting plate or disk 24 and mounting screws 26 are used. Mounting disk 24 includes a disk-like body 28 and a set of mounting screw positioners 29 as will be described below.

Figure 3:
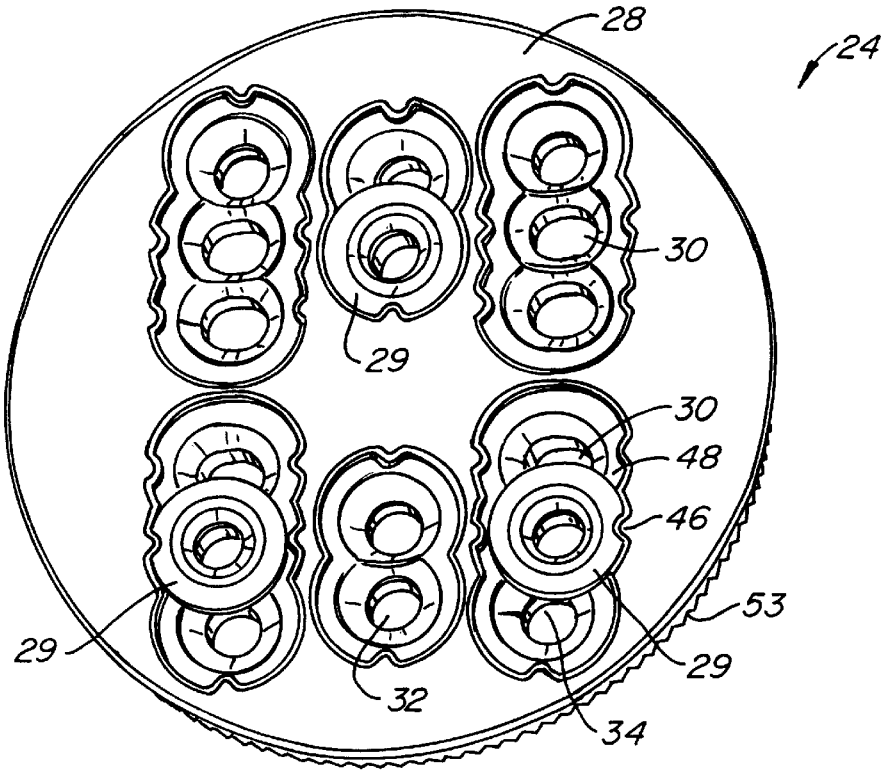
FIG. 3 illustrates the body of FIG. 2 with three mounting screw positioners to form a snowboard binding mounting disk for use with a snowboard having a 3-hole mounting hole pattern.

Prior to discussing mounting disk 24 in detail, 3-hole and 4-hole patterns 8,10 will first be described. As can be seen in FIG. 1A, 3-hole pattern has centers identified as X's and has a base dimension of Z. The centers of 4-hole pattern 10, identified as O's, have an end dimension of Y. The difference between Z and Y equals delta. For a conventional 3-hole pattern Z=43 mm, while for a conventional 4-hole patterns Y=40 mm, so that delta=3 mm. Screws 26 have a diameter of about 6 mm. When the holes are aligned as suggested in FIG. 1A, that is with the base holes of the 3-hole pattern and the end holes for the 4-hole pattern laterally aligned and adjacent to one another, the holes are close enough so that the through-holes formed through body 28 of mounting disk 24 overlap one another to form dual-purpose holes 30 as discussed below.

The present invention recognizes that dual purpose holes 30 can be created for some of the holes formed in body 28 so that a single body can be used for both sets of 3-hole and 4-hole patterns.

Figure 2:
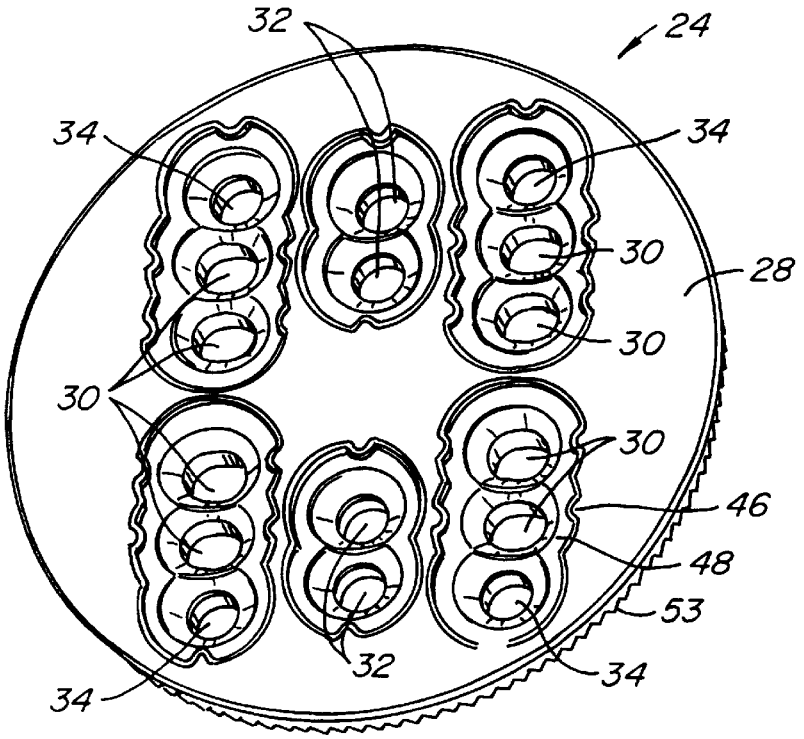
FIG. 2 is an isometric view of the body of the mounting disk of FIG. 1.

FIG. 2 illustrates disk 28 with four sets of 3-hole patterns 8 and three sets of 4-hole patterns 10 combining to create four pairs of dual purpose holes 30. In addition to dual purpose holes 30, four 3-hole pattern holes 32, and four 4-hole pattern holes 34 are formed in body 28.

Figure 4:
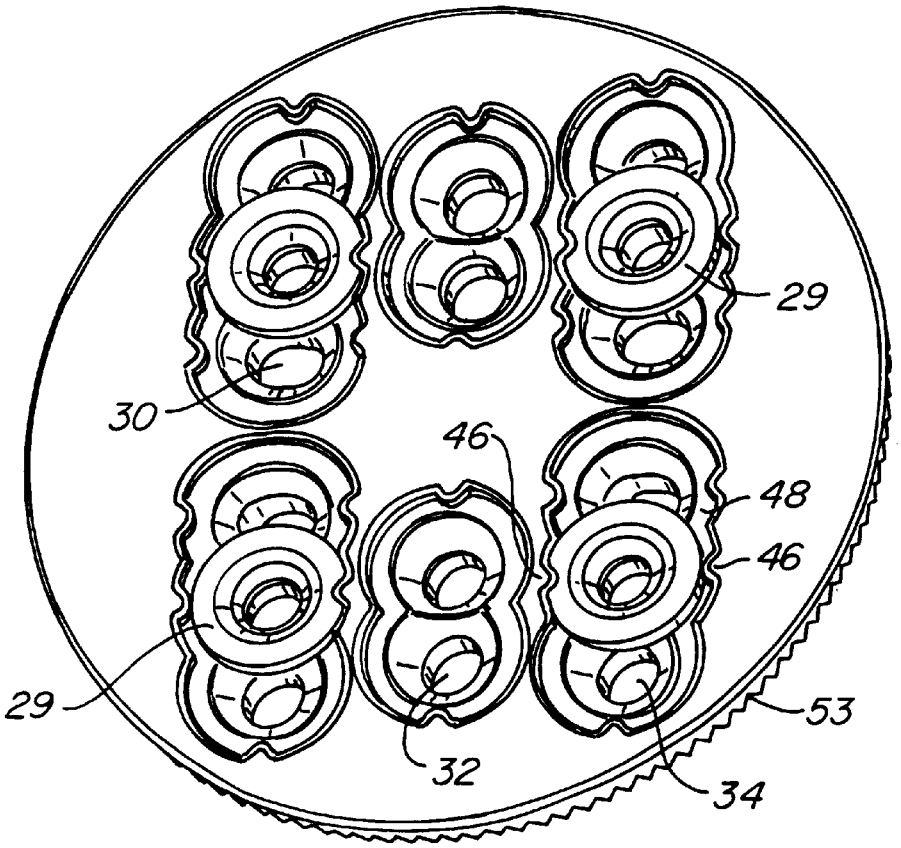
FIG. 4 is a view similar to that of FIG. 3 but including four mounting screw positioners arranged for mounting the snowboard binding to a snowboard having a 4-hole mounting hole pattern.
Figure 5:
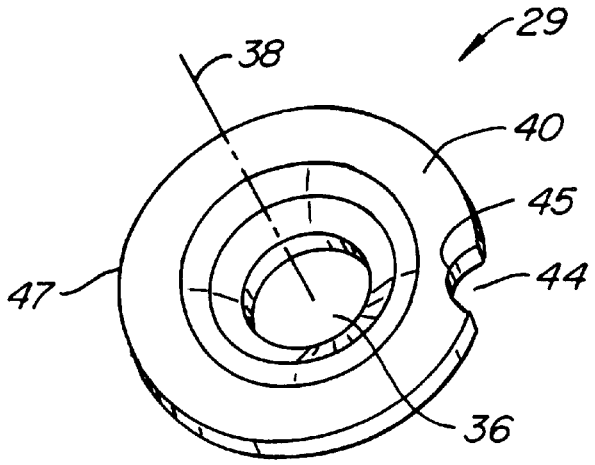
FIG. 5 is an enlarged isometric view of a mounting screw positioner.

FIG. 3 illustrates mounting disk 24 in a 3-hole pattern configuration. That is, two of the dual purpose holes 30 are used to support, position and house two mounting screws positioners 29, see FIG. 5, and one of the 3-hole pattern holes 32 is used to position one mounting screw positioner 29. Similarly, FIG. 4 illustrates two pairs of mounting screw positioners 29 engaging two pairs of the dual purpose holes 30, the lower most set of holes being the same dual purpose holes as engaged in FIG. 3. Two of the 3-hole patterns 8 are used with body 28 oriented as illustrated and the other two patterns 8 are used with a body 28 rotated 180° from the FIG. 3 orientation. All three of 4-hole patterns 10 can be used with body 28 oriented as in FIG. 4 and with body 28 rotated 180° from the FIG. 4 orientation.

Body 28 includes three sets of 4-hole patterns 10. Patterns 10 are preferably not centered on body 28 so that mounting disk 24 provides three positions for binding 2 on snowboard 4 in one orientation and three additional positions for the binding when disk 24 is rotated 180°. Body 2 includes four sets of 3-hole patterns 8. Two of the sets of 3-hole patterns 8 are in a first orientation and the other two sets are in a second orientation 180° from the first orientation. Holes 32 are all different distances from the center of body 28 so that disk 24 permits binding 2 to be mounted at four different positions along snowboard 6.

As can be seen by comparing the figures, mounting screw positioners 29 in FIG. 3, when engaging the dual purpose holes 30, are in one rotary orientation, while in FIG. 4 positioners 29 are in a different rotary orientation, 180° apart from the orientation of FIG. 3. This change in rotary orientation of mounting screw positioners 29 is used to laterally shift the center of the central hole 36 formed in positioner 29 to accommodate the different hole centers illustrated in FIG. 1A.

Figure 6:
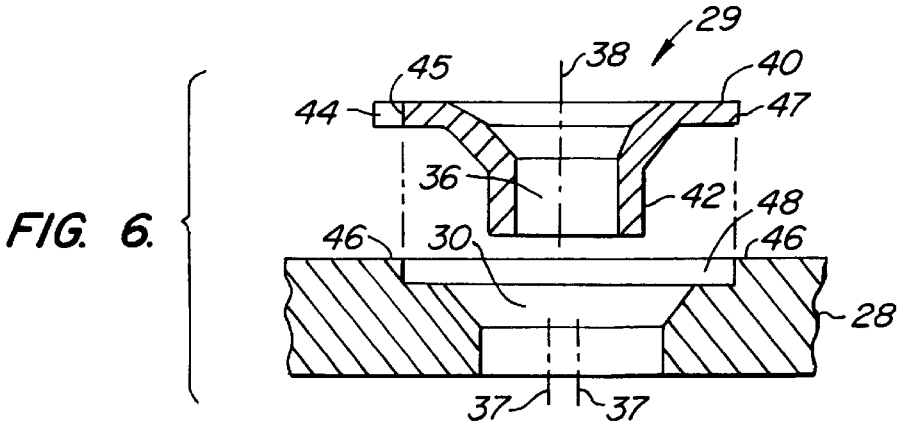
FIG. 6 is an enlarged, exploded partial cross-sectional view showing the relative positions of a mounting screw positioner aligned with a dual purpose hole formed in the body of the mounting disk.
Figure 7:
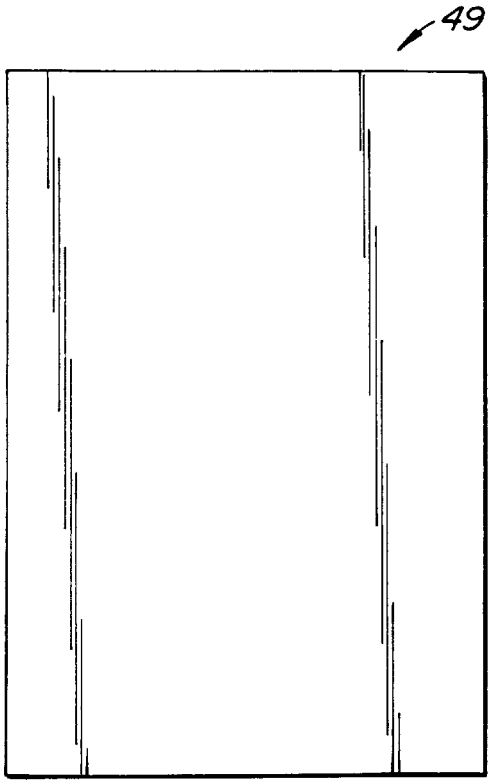
FIG. 7 is a plan view of a flat sheet of aluminum from which the base of FIG. 1 is to be formed.
Figure 8:
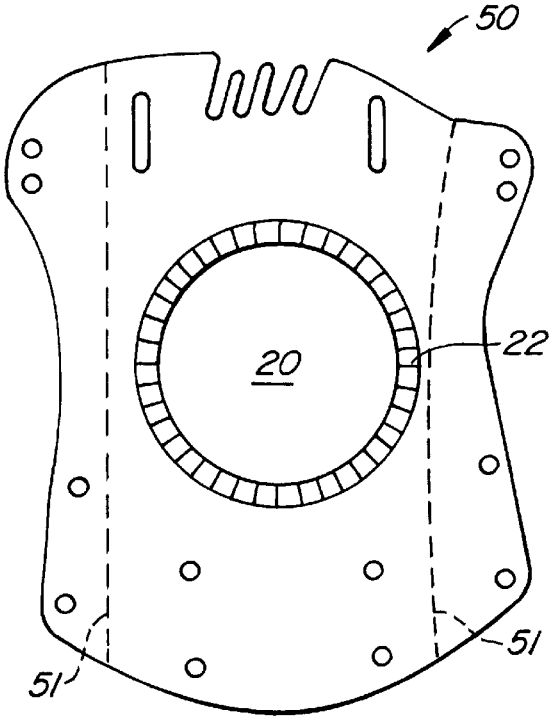
FIG. 8 is a plan view of the base blank made from the sheet of FIG. 7 by a stamping operation.
Figure 9A:
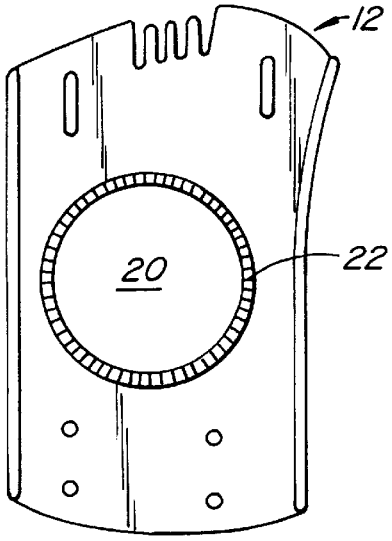
FIGS. 9A and 9B are plan and end views of the base of FIG. 1 made by bending the lateral edges of the base blank of FIG. 8 along the dashed lines of FIG. 8.
Figure 9B:
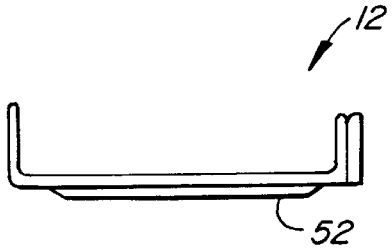

FIG. 6 is an exploded cross-sectional view of a positioner 29 and a portion of body 28, such as would be taken of the lower left positioner in FIG. 3. Dual purpose hole 30 is an oblong hole having a relatively short, straight central section and two semi-circular end sections, each end section having its own center line 37 as shown in FIG. 6. The distance between center lines 37 of hole 30 is equal to half of delta, in the preferred embodiment about 1.5 mm.

To ensure that the mounting screw 26 passing through positioner 29 is properly aligned with the appropriate mounting hole formed in snowboard 8,10, mounting hole 29 and positioner 30 are sized and configured so that the center line 38 of positioner 29 can be aligned with either of the two center lines 37 of dual purpose hole 30. In the preferred embodiment this is achieved by forming positioner 29 with an outwardly radially extending flange 40 and a downwardly extending, generally cylindrical guide tube 42. Hole 36 is configured to accommodate a screw 26. Flange 40 has a recess 44 sized to receive an extension 46 extending into a positioner flange recess 48 formed in body 28. Center line 38 is thus laterally offset relative to a first point 45 at the base of recess 44 and a second point 47 on the opposite side of the outer edge of flange 40. Positioner flange recess 48 is a part of dual purpose hole 30 and is sized to house flange 40. As seen in FIGS. 3 and 4, the distance between extensions 46 is such that positioner 29 will fit within hole 30 only if recess 44 engages one of the extensions 46, the periphery of flange 40 lying adjacent extension 46 on the opposite side of hole 30. It should be noted that 3-hole pattern holes 32 and 4-hole pattern holes 34 have a single extension 46 for each hole. While the use of extensions 46 for these single purpose holes is not required, doing so keeps mounting screw positioners 29 from rotating within the holes.

In addition to properly positioning mounting screws 26 within dual purpose holes 34, mounting screw positioners 29 also are useful for distributing the load of screws 26 over a larger area of base 28. This is especially helpful when base 28 is made of a plastic material, rather than a metal such as aluminum.

Conventional snowboard binding 2 are typically made with base 12 made of aluminum or an engineering plastic, such as nylon, polycarbonate, urethane, blends of nylon, blends of polycarbonate or blends of urethane, each of which can be made with or without glass fiber. When made of a molded plastic, grooved peripheral surface 22 is simply formed as part of the molding process. When base 12 is made of aluminum or some other metal, grooved peripheral surface 22 is most commonly machined into the base. With the present invention, grooved peripheral surface 22 is preferably not machined but is rather formed by a stamping operation.

FIGS. 7–9B illustrate the steps in making a base 28 from a sheet 49 of a metal, typically aluminum. Sheet 49 is stamped to create the stamped blank 50 of FIG. 8. Blank 50 is then bent along dashed lines 51 to create base 12, shown in FIGS. 9A and 9B. Base 12 is typically anodized or otherwise surface treated for enhanced corrosion resistance.

Figure 10:
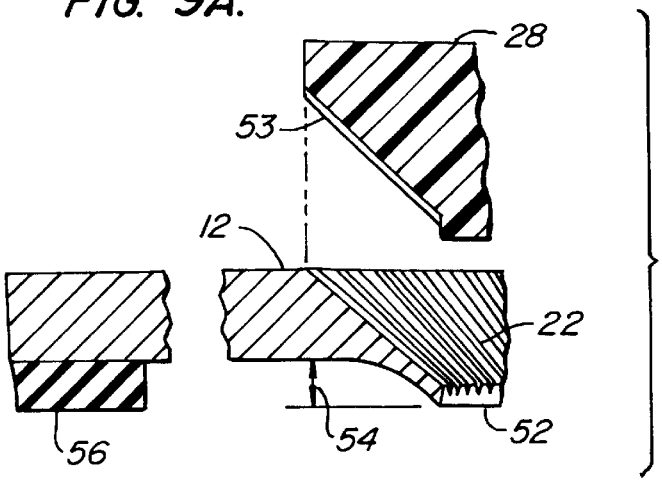
FIG. 10 is an enlarged, exploded partial cross-sectional view of the grooved surfaces of the base and the body of the disk of FIG. 1 and of a support pad of the base of FIG. 1.
Figure 11:
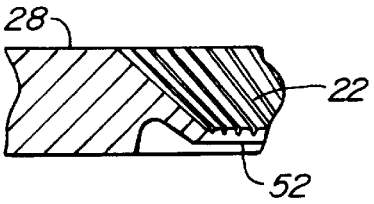
FIGS. 11 and 12 illustrates two alternative embodiments of the stamped central opening of FIG. 10.
Figure 12:
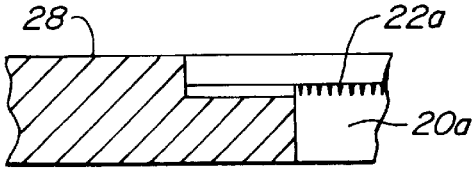

FIG. 10 is an enlarged, simplified cross-sectional view of a portion of base 12 in which the stamped, grooved peripheral surface 22 is shown positioned opposite the grooved peripheral surface 53 of body 28. Due to the stamping process, the lower edge 52 of peripheral surface 22 extends beneath the lower surface of base 12 by a distance 54. This distance is typically about 1.60 mm. To ensure that base 12 rests securely on snowboards 8,10, various resilient pads 56 are used on the bottom of base 12 to provide the necessary stable support for base 12. Stamped, grooved peripheral surface 22 could be formed in a manner so that lower edge 52 does not extend below the bottom of base 12. One way to do so is suggested in FIG. 11. This embodiment eliminates the need for resilient pads 56 or other such extensions. A further embodiment of a coined, grooved peripheral surface is shown in FIG. 12 as surface 22*a*. Surface 22*a* is not a sloped surface as is surface 22 of FIGS. 10 and 11, but rather is in the plane of body 28. The embodiment also eliminates the deflection of edge 52 below the bottom of base 12.

By stamping rather than machining grooved peripheral surface 22, base 12 can be made at a substantially lower cost. It has been found that manufacturing body 28 of mounting disk 24 as a molded plastic part from a suitably strong plastic material, such as nylon, polycarbonate, urethane, blends of nylon, blends of polycarbonate or blends of urethane, each of which can be made with or without glass fiber, coupled with making base 12 of stamped aluminum with stamped peripheral surface 22, enables binding 2 to be made at a lower cost than conventional binding using metal bodies and metal mounting disk, but with the strength and structural rigidity achievable using such conventional metal bindings.

Figure 13A:
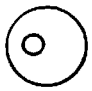
FIGS. 13A–13D are simplified plan views of alternative embodiments of the mounting element positioner of FIG. 5.
Figure 13B:
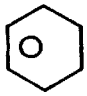
Figure 13C:
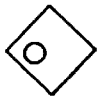
Figure 13D:
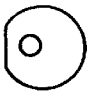

Modification and variation can be made to the disclosed embodiments without departing from the subject of the invention as defined in the following claims. For example, the lower, vertical bore of dual purpose holes 30 could be made such that two holes simply overlap so that the sidewall of the hole forms somewhat of a FIG. 8 pattern rather than the oval pattern illustrated in the figures. While it is preferred to make base 28 out of a plastic, other materials including layered composites and metals can also be used. The invention can be used when other patterns of mounting holes are to be accommodated by a single mounting disk 24; for example, two different 4-hole patterns or a 3-hole or a 5-hole pattern could be used. Flange 40 is generally circular; it could be other regular or irregular shapes as well. Mounting screw positioner 29 could be made with flange 40 completely circular, rectangular, hexagonal, etc. (with no recess 40) by making guide tube 42 and hole 36 eccentric by one-half of delta. See FIGS. 13A, 13B and 13C. Positioner 29 could also have a D-shaped flange 49 with hole 36 closer to the flat side of the D than the rounded side of the D. See FIG. 13D. Positioner 29 could be made to include only guide tube 42; in such an embodiment, the positioning would include a vertically extending recess which would mate with one of two extensions formed in the lower part of dual purpose hole 30. This type of mounting screw positioner would, however, not provide the additional function of distributing the load exerted by mounting screws 26 against body 28. Resilient pads 56 could be replaced by other materials or by one-piece extensions of base 12.

What is claimed is:

1. A snowboard binding mounting disk comprising:

a body having upper and lower surfaces surrounded by a peripheral body edge;

a first pattern of first mounting holes formed through the body, each said first mounting hole having a center, said centers of said first mounting holes comprising a pair of first centers, said first centers separated by a first distance;

a second pattern of second mounting holes formed through the body, each said second mounting hole having a center, said centers of said second mounting holes comprising a pair of second centers, said second centers separated by an second distance which differs by a distance delta;

said pair of first mounting holes and said pair of second mounting holes being positioned adjacent to one another so said first and second mounting holes overlap one another to create a pair of oblong, dual purpose holes;

positioners, each said positioner having a peripheral positioner edge and defining a mounting element guide hole therethrough, said mounting element guide hole being laterally offset with respect to first and second points on said peripheral positioner edge, said first and second points being on opposite sides of said mounting element guide hole; and said body defining first and second contact members on opposite sides of each of said dual purpose holes sized for engagement of said first and second points of said peripheral positioner edge when said positioner is in first and second orientations, whereby the positioners locate said mounting element guide holes at a chosen one of said pair of first centers or said pair of second centers according to whether the first or second pattern of mounting holes is to be used.

2. The mounting disk according to claim 1 wherein said body defines a positioner recess at said dual purpose holes, said first and second contact members comprising first and second extensions extending into said positioner recess.

3. The mounting disk according to claim 1 wherein said positioner has a radially-extending flange and an axially-extending guide tube, said first point comprising a recessed region formed in said flange.

* * * * *